US006357636B2

(12) United States Patent
Feygin

(10) Patent No.: US 6,357,636 B2
(45) Date of Patent: Mar. 19, 2002

(54) ARTICLE AND METHOD FOR FLOW CONTROL IN LIQUID DISPENSING DEVICES

(75) Inventor: Ilya Feygin, Mountainside, NJ (US)

(73) Assignee: Pharmacopeia, Inc., Princeton, NJ (US)

( * ) Notice: Subject to any disclaimer, the term of this patent is extended or adjusted under 35 U.S.C. 154(b) by 0 days.

(21) Appl. No.: 09/886,425

(22) Filed: Jun. 21, 2001

Related U.S. Application Data

(62) Division of application No. 09/395,383, filed on Sep. 14, 1999, now abandoned.

(51) Int. Cl.[7] ..... B67D 3/00
(52) U.S. Cl. ..... 222/564; 222/1
(58) Field of Search ..... 222/1, 394, 564, 222/566

(56) References Cited

U.S. PATENT DOCUMENTS

| | | | | |
|---|---|---|---|---|
| 718,759 | A | | 1/1903 | Hendrix |
| 1,767,680 | A | | 6/1930 | Hutt |
| 1,938,036 | A | | 12/1933 | Martin et al. |
| 4,154,378 | A | | 5/1979 | Paoletti et al. |
| 5,056,462 | A | * | 10/1991 | Perkins et al. ..... 222/1 |
| 5,741,554 | A | | 4/1998 | Tisone |
| 6,173,862 | B1 | * | 1/2001 | Buca et al. ..... 222/1 |

* cited by examiner

*Primary Examiner*—Kevin Shaver
*Assistant Examiner*—Thach H Bui
(74) *Attorney, Agent, or Firm*—DeMont & Breyer, LLC; Wayne S. Breyer; Jason Paul DeMont

(57) ABSTRACT

Flow-regulation means for improving the operation of a liquid dispenser, and liquid dispensers incorporating the same, are disclosed. In some embodiments, the flow-regulation means includes a conduit for receiving a pressurized fluid, wherein a flow restriction restricts the flow of the pressurized fluid into the conduit. The flow restriction has a smaller flow area than the outlet of the dispensing valve. As a result, fluid is re-supplied to the conduit more slowly than it is dispensed through the dispensing valve. In further embodiments, at least a portion of the conduit is elastic. A dynamic pressure sensor is used to sense pressure in the elastic region. In an additional embodiment, the flow-regulation means includes a resilience-adjustment means operable to adjust the resilience or elasticity of an elastic portion of the conduit. Such adjustable resilience provides an additional measure of control over the dispensing process. In additional embodiments, the present flow-regulation means incorporates various combinations of the above-described features.

12 Claims, 2 Drawing Sheets

ARTICLE AND METHOD FOR FLOW CONTROL IN LIQUID DISPENSING DEVICES

CROSS REFERENCE TO RELATED APPLICATIONS

This is a divisional of U.S. patent appliation Ser. No. 09/395,383 filed Sep. 14, 1999 and now abandoned.

FIELD OF THE INVENTION

The present invention relates to liquid dispensing devices. More particularly, the present invention relates to a method and apparatus for providing enhanced control/regulation over the delivery of micro volumes of liquid from such liquid dispensing devices.

BACKGROUND OF THE INVENTION

Automated dispensing of miro-liter quantities of fluids is required, or at least desirable, in pharmaceutical, combinatorial chemistry, high-throughput screening and medical diagnostic applications. It is difficult, however, to accurately dispense fluids in micro-liter quantities.

In particular, it is very difficult to dispense liquid in an amount in the range of about 0.1–2 micro liters while minimizing cross-contamination between the dispenser and a receiver. To substantially eliminate the incidence of crosscontamination, a "non-touch off" method of fluid delivery is used. In such a method, there should be no contact between a droplet being dispensed and the receiver (or fluid or other material in the receiver) until the droplet completely disengages from the tip of the dispenser. Non-touch-off transfer requires supplying kinetic energy to a droplet in an amount sufficient to overcome the surface tension of the dispensing tip and to dispense the droplet with sufficient momentum that it can be accurately and reliably directed to a desired destination.

Techniques borrowed from the printing industry (e.g., ink jet printers) have been used to create dispensers for dispensing liquid volumes of less than about 100 nano-liters. Such dispensers use piezo, thermal, magnetostrictive and other means of generating micro deformations to displace and supply kinetic energy to nano-liter quantities of fluid. Such methods/apparatuses are limited, however, to dispensing nano-liter volumes of fluid, and are also very sensitive to fluid parameters. These methods and apparatuses are therefore of limited utility for pharmaceutical, combinatorial chemistry, high-throughput screening and medical diagnostic applications wherein the characteristics of the liquids may vary widely from application to application.

Methods/apparatuses capable of non-touch-off transfer of liquid volumes in the range of about 0.1 to about 3 microliters include "shake off" methods and methods that use valving mechanisms for portioning out a desired volume. Dispensers that incorporate such valving mechanisms have proven to be difficult to implement due to a variety of factors, as discussed below.

Some prior art valve-implemented dispensers utilize a "positive-displacement" method wherein a predetermined portion of fluid is pressurized into the valve while a synchronized valve controller appropriately actuates the valve. See, for example, U.S. Pat. No. 5,741,554. While developed to provide improved precision for the delivery of micro-liter volumes of fluid, the positive-displacement method has a number of shortcomings.

In particular, dispensers utilizing this method depend on precise coordination of all controls, a suitably elastic liquid channel (apparently overlooked in U.S. Pat. No. 5,741,554), and are subject to temperature variations, variations due to entrapped or internally-released gas bubbles, as well as variations in other parameters.

Positive-displacement dispensers also suffer from an unavoidable drop in liquid pressure during each individual dispense cycle caused by the delay between syringe (piston) action and high speed valve operation. This, in turn, results in variations in droplet formation, wherein an insufficient quantity of kinetic energy is available to cause droplet separation during the "falling edge" phase of the droplet-forming pressure pulse.

As such, there is a need for improvements in the liquid dispensers of the prior art.

SUMMARY OF THE INVENTION

Flow-control/regulation means for improving a liquid-dispensing operation, and liquid dispensers incorporating the same, are disclosed. In a first embodiment, the flow-regulation means comprises a conduit for receiving a pressurized fluid, wherein said conduit is in fluid communication with a dispensing valve for dispensing the fluid. As used herein, the phrase "fluid communication," indicates that fluid (i.e., liquid and/or gas) can flow directly between two regions (i.e., the two regions that are described to be in fluid communication). Flow is regularly re-supplied to the dispensing valve, so the problem suffered by positive-displacement dispensers concerning the availability of sufficient pressure during the entire dispensing cycle is avoided.

In the first embodiment, a flow restriction restricts the flow of the pressurized liquid into the conduit. The flow restriction, which in some embodiments is realized as a restriction orifice, has an orifice that is smaller than the outlet opening or orifice of the dispensing valve. As a result, liquid is re-supplied to the conduit more slowly than it is dispensed through the dispensing valve. Since the re-supply rate is less than the dispensing rate, a relatively smaller error results from delays in valve closing than would otherwise occur.

In a second embodiment, the flow-regulation means comprises a conduit for receiving liquid to be dispensed, wherein said conduit is in fluid communication with a dispensing valve. In the second embodiment, at least a portion of the conduit is elastic. A dynamic pressure sensor senses pressure in the elastic region. Such pressure can be correlated to the amount of liquid discharged from the dispenser, can provide an indication of operating problems, or can provide corrective control.

In a third embodiment, the flow-regulation means comprises a conduit for receiving liquid to be dispensed, wherein said conduit is in fluid communication with a dispensing valve. Again, at least a portion of the conduit is elastic. In this embodiment, the flow-regulation means also comprises a resilience-adjustment means operable to adjust the resilience or elasticity of the elastic portion of the conduit. Such adjustable resilience provides an additional measure of control over the dispensing process. In particular, the resilience-adjustment means can compensate for changes in fluid characteristics (e.g., viscosity, etc.) as well as for changes in the elasticity of the elastic portion of the conduit or in the mechanical operation of the dispensing valve.

In additional embodiments, a flow-regulation means in accordance with the present teachings comprises various combinations of the features of embodiments one, two and three.

DETAILED DESCRIPTION

Figure 1:
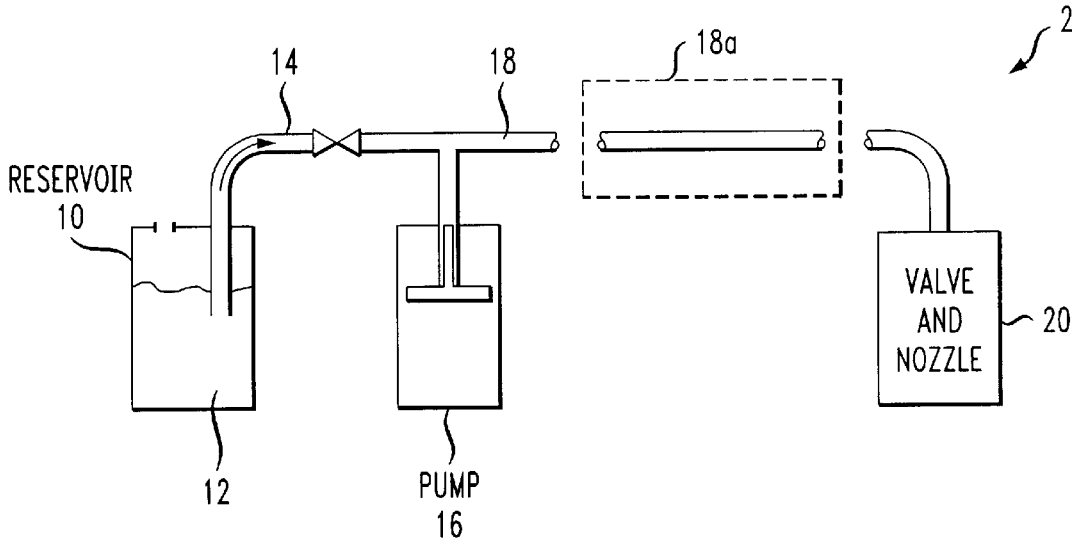
FIG. 1 depicts a conventional fluid-dispensing device.

The present invention is directed to improvements in liquid dispensers, such as conventional positive-displacement-type liquid dispenser 2 depicted in FIG. 1. Liquid dispenser 2 includes a reservoir 10 containing liquid 12, tubing 14 leading to positive-displacement pump 16, and tubing 18 leading to valve/nozzle 20. In operation, liquid 12 is drawn from reservoir 10 through tubing 14 into pump 16. Liquid 12 is discharged into tubing 18 towards valve/nozzle 20.

Some of the improvements disclosed herein are suitably incorporated into conventional liquid dispensers, such as liquid dispenser 2, in the region identified as "18*a*" in FIG. 1. The present invention is also applicable to a variety of other types of liquid dispensers, including, for example, those in which the liquid reservoir is maintained under constant elevated pressure. In fact, the illustrative embodiments presented herein depict a liquid reservoir (i.e., reservoir 102 in FIGS. 2–4) that is under constant pressure for feeding the inventive apparatuses.

Elastic Conduit & Dynamic Pressure Sensing

Figure 2:
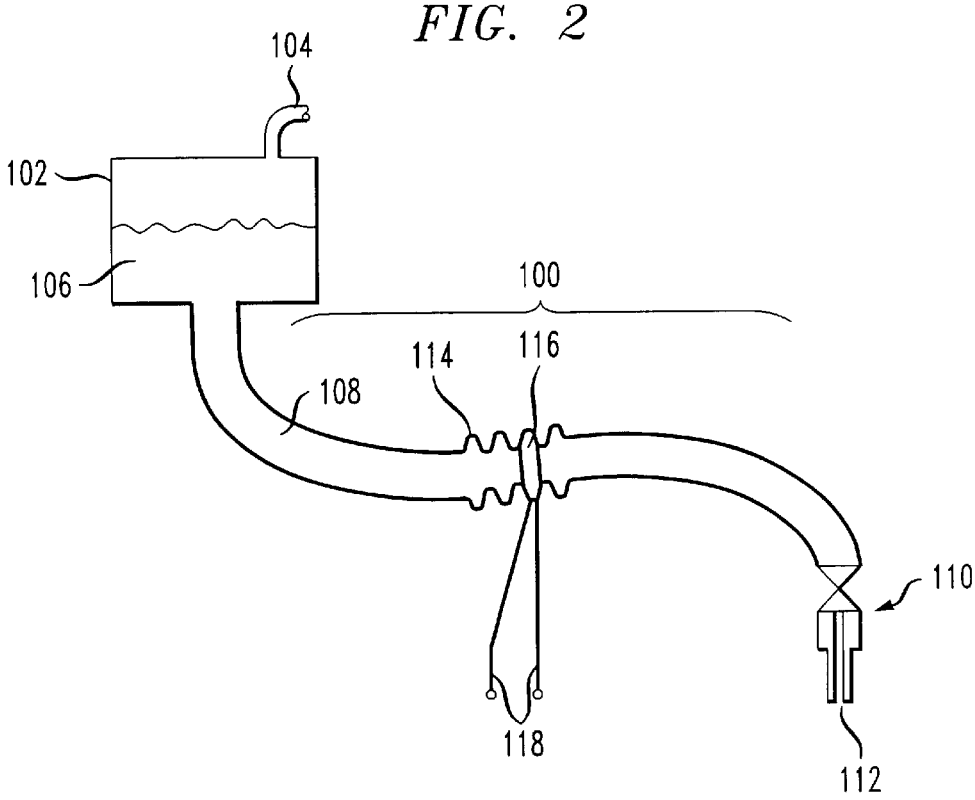
FIG. 2 depicts a first embodiment of a flow-regulation means for improving operation of liquid dispensing devices.

FIG. 2 depicts a first embodiment of flow-regulation means 100 for improving the reliability and accuracy of fluid-dispensing operations. Supply line 104 provides gas (e.g., nitrogen, etc.) for maintaining pressure in reservoir 102. Liquid 106 is provided to apparatus 100 from reservoir 102. Apparatus 100 delivers liquid 106 to valve 110 for dispensing through opening 112.

Flow-regulation means 100 comprises conduit 108 that includes elastic region 114, and a pressure sensor 116. Pressure sensor 116 is operable to sense pressure in elastic region 114. Leads 118 from sensor 116 connect to appropriate electronics (not shown) for processing sensor data and displaying and/or recording such data. Monitoring the pressure in conduit 108 as it falls and rises during respective dispensing and refilling cycles provides information that can be correlated to an amount of liquid dispensed and also can provide indications of operational problems (e.g., occlusions in the conduit 108 and/or valve 110).

Incorporating elastic region 114 facilitates use of a dynamic pressure sensor 116, which may be disposed on region 114. A static pressure-measurement device is required when the liquid conduit (e.g., conduit 108) is inelastic and disposed in the channel as a "flow-through" sensor. Dynamic pressure sensors are much less expensive (i.e., about an order of magnitude) than static pressure sensors and do not require insertion into conduit 108. Such insertion usually creates a "dead volume" and presents the possibility for introducing contamination in conduit 114.

In some embodiments, data from pressure sensor 116 can be utilized in a control loop (not depicted) to adjust the operation of valve 110 for changing timing or to adjust the supply pressure to compensate for temperature variations, fluid parameters (e.g., viscosity), partial valve occlusion, and the like.

Elastic Conduit & Resilience Control

Figure 3:
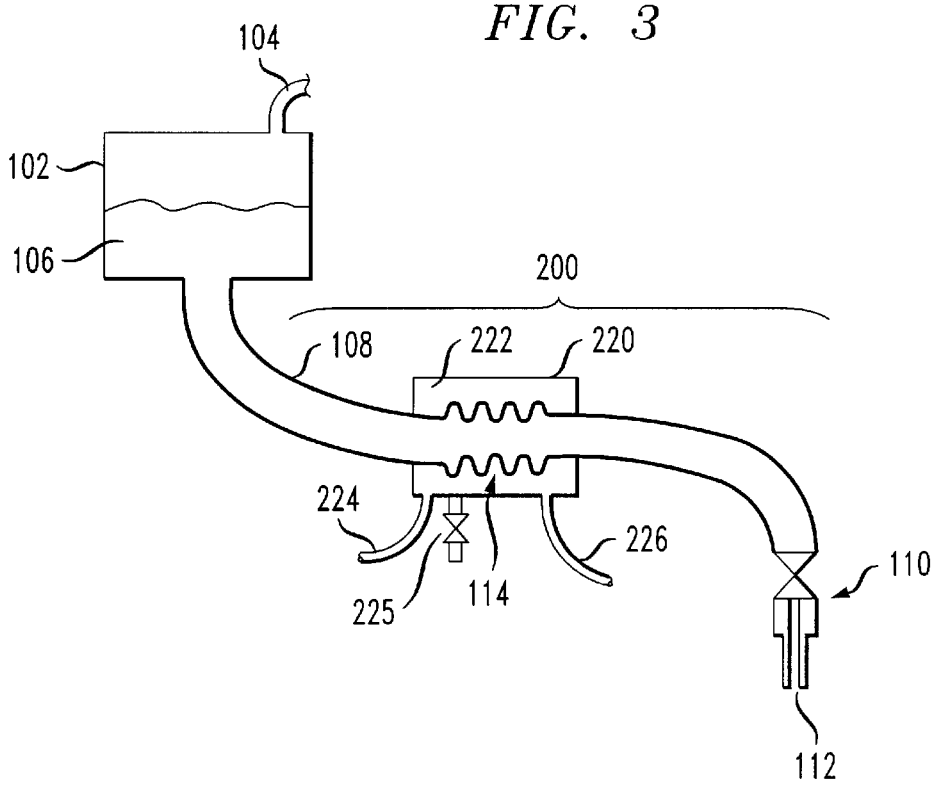
FIG. 3 depicts a second embodiment of a flow-regulation means for improving operation of liquid dispensing devices.

FIG. 3 depicts a second embodiment of a flow-regulation means 200 in accordance with the present teachings. As in apparatus 100, supply line 104 provides gas (e.g., nitrogen, etc.) for maintaining pressure in reservoir 102. Liquid 106 is provided to flow-regulation means 200 from reservoir 102. Flow-regulation means 200 delivers liquid 106 to valve 110 for dispensing through opening 112.

Like flow-regulation means 100, illustrative flow-regulation means 200 comprises conduit 108 that includes elastic region 114. In accordance with the present teachings, flow-regulation means 200 further includes resilience-adjusting means that is operable to adjust the "resilience" or "elasticity" of elastic region 114.

Such adjustable resilience provides a further measure of control over the dispensing process. For example, resilience-adjusting means provides a way to adjust for "aging" of the conduit material. In particular, if elastic region 114 loses resilience over time, the resilience-adjusting means can be used to return the liquid dispenser to a baseline operation. Moreover, the resilience-adjusting means provides a way to compensate for variations in fluid parameters (e.g., changes in viscosity, etc.) from a baseline condition, which variations would otherwise affect fluid dynamics within the dispenser, and, hence, the operation thereof. Thus, the resilience-adjusting means advantageously maintains a baseline operation for the dispenser notwithstanding changed system conditions.

In the embodiment depicted in FIG. 3, the resilience-adjusting means comprises an enclosure 220 that defines a pressure-tight chamber 222 surrounding at least a portion of elastic region 114, and a pressure-adjustment means. In some embodiments, pressure-adjustment means is implemented by gas supply conduit 224 that delivers gas (e.g., nitrogen, etc.) to chamber 222, and a pressure regulator 225. Additionally, optional vacuum-flow conduit 226 is connected to a vacuum source (not shown).

Increasing the pressure within chamber 222 effectively increases the resilience of elastic region 114 (at least the externally pressurized portion thereof). Conversely, decreasing pressure within chamber 222 decreases the resilience of elastic region 114.

If a vacuum source is not available, the reference or baseline conditions for the dispensing operation is advantageously set with an elevated pressure within chamber 222 (i.e., elevated above the operating pressure within conduit 108). Doing so provides an ability to decrease pressure (below the baseline pressure setting), hence decreasing the resilience of region 114, as required. If the baseline operation is set with only ambient pressure on the exterior of region 114, and a vacuum source is not available, then the ability to decrease resistance by lowering pressure is forfeited.

Flow Restriction

Dispensers that provide a constant "re-supply" of liquid to replace dispensed liquid (e.g., those wherein the dispensing energy is provided by a pressurized reservoir, etc.) are prone to inaccuracy. Such inaccuracy is related to characteristics of the dispensing valve.

In particular, the amount of liquid dispensed from such dispensers is proportional to the amount of time that the dispensing valve is open (as well as pressure, fluid viscosity, etc.). The behavior of dispensing valves (e.g., valve 110) that are typically used in such dispensers is such that there is a rapid response to an impulse (e.g., voltage) to open, but the closure response tends to be less precise. Reasons for such impression include, for example, variations in fluid parameters (e.g., viscosity), aging of the valve spring, contamination, and the like. As such, an additional error in the amount of liquid dispensed can be introduced due to valve operation. For example, if a dispensing operation dispenses 1 micro-liter of liquid in 20 milliseconds, and there is a 2 millisecond delay on valve closure, then an error of 2/20 or 10 percent in the amount of dispensed liquid has occurred.

Positive-displacement type dispensers use a fluid "pulse" having a calibrated volume in an attempt to avoid the problem described above. Such dispensers do not provide a continuous refill; rather, a discrete amount of liquid is metered towards the dispensing valve/nozzle 20 in response to a compressive stroke of pump 16 (see, FIG. 1). Valve/nozzle 20 opens to dispense liquid 12 and thereafter closes. After the compressive stroke, the pump draws liquid from reservoir 10 for the next dispensing pulse. Liquid 12 is not advanced towards the dispensing valve/nozzle during this pump-charging operation. Since no "re-fill" liquid is present to be dispensed until the subsequent dispensing pulse, no "extra" liquid can be dispensed if valve closure is sluggish.

Although a discrete amount of liquid 12 is advanced by pump 16 during the dispensing pulse, to actually dispense that amount of liquid from valve 20 is problematic.

In particular, as valve 20 opens to dispense the desired volume of fluid, the pressure rapidly drops. As the pressure nears ambient, the energy available for dispensing is insufficient to dispense the remaining liquid. Thus, the full volume of fluid that is advanced toward the dispensing valve during each dispensing pulse is not dispensed.

Figure 4:
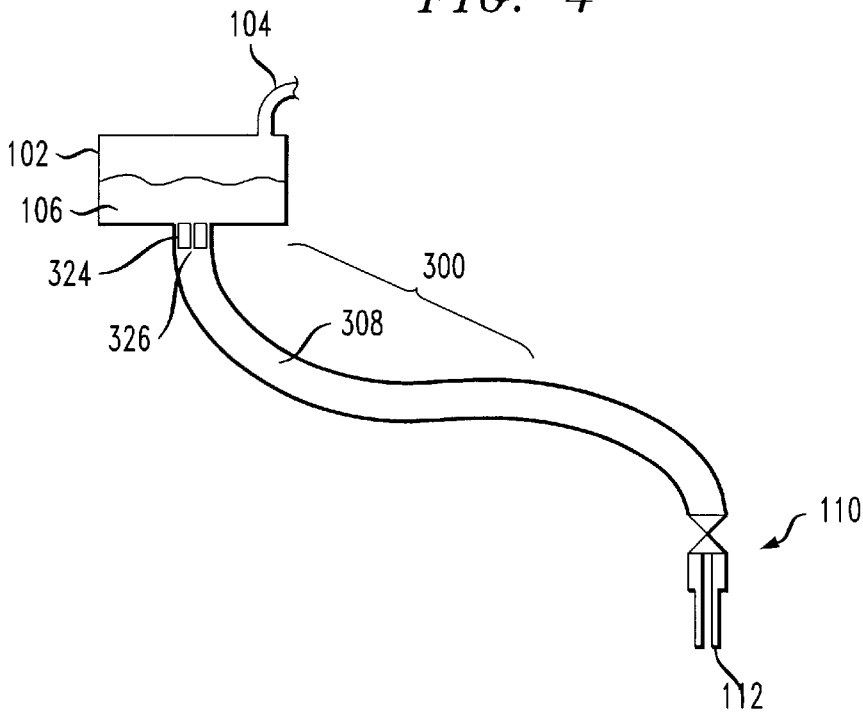
FIG. 4 depicts a third embodiment of a flow-regulation means for improving operation of liquid-dispensing devices.

FIG. 4 depicts a third embodiment of a flow-regulation means 300 in accordance with the present teachings that addresses the problems described above. As in flow-regulation means 100 and 200, supply line 104 provides gas (e.g., nitrogen, etc.) for maintaining pressure in reservoir 102. Liquid 106 is provided to flow-regulation means 300 from reservoir 102. Flow-regulation means 300 delivers liquid 106 to valve 110 for dispensing through opening 112.

In accordance with the present teachings, flow-regulation means 300 comprises a flow restriction, illustratively embodied as restriction orifice 324. Restriction orifice 324 has an outlet orifice 326 that is smaller than opening 112 of dispensing valve 110. As a result, liquid 106 is re-supplied to flow-regulation means 300 more slowly than it is dispensed through valve 110. Since the re-supply rate is less than the dispensing rate, a relatively smaller error results from any delay in valve closing than would otherwise occur, while a continuous refill of conduit 308 is advantageously provided.

Unlike conduit 108 of flow-regulation means 100 and 200 that incorporates elastic region 114, conduit 308 of illustrative flow-regulation means 300 does not incorporate such an elastic region. It should be understood, however, that in other embodiments of the present invention, a flow restriction is used in conjunction with a conduit having an elastic region, such as conduit 108 having elastic region 114.

Moreover, it will be appreciated that while conduit 108 is depicted as being only partially elastic (i.e., incorporating elastic region 114), in other embodiments, a fully-elastic conduit replaces partially-elastic conduit 108.

In further embodiments, flow-regulation means in accordance with the present invention includes various combinations of features described in this Specification. For example, in one embodiment, the present flow-regulation means comprises an elastic region, a dynamic pressure sensor, and a resilience-adjusting means. In another embodiment, the present flow-regulation means incorporates an elastic region, a dynamic pressure sensor, and a flow restriction. In a further embodiment, the present flow-regulation means comprises an elastic region, a resilience-adjusting means, and a flow restriction. And in an additional embodiment, the present apparatus comprises an elastic region, a dynamic pressure sensor, a resilience-adjusting means, and a flow restriction.

It is to be understood that the above-described embodiments are merely illustrative of the invention and that many variations may be devised by those skilled in the art without departing from the scope of the invention and from the principles disclosed herein. It is therefore intended that such variations be included within the scope of the following claims and their equivalents.

I claim:

1. A liquid dispenser comprising:

a pressurized liquid source;

a dispensing valve that dispenses a quantity of said pressurized liquid;

a conduit that places said pressurized liquid source in fluid communication with said dispensing valve, wherein at least a portion of said conduit is elastic;

a flow-control/flow-regulation element that is operably engaged to said conduit, wherein said flow-control/flow-regulation element comprises:

a flow restriction that restricts flow of said pressurized liquid into said conduit; and a pressure sensor that is engaged to an exterior of said elastic portion of said conduit, wherein said pressure sensor senses pressure within said elastic portion of said conduit.

2. The liquid dispenser of claim 1, wherein:

said flow restriction has a first orifice;

said dispensing valve has a second orifice; and said first orifice is smaller than said second orifice.

3. The liquid dispenser of claim 1 wherein said pressure sensor is a dynamic pressure sensor.

4. The liquid dispenser of claim 1 wherein said flow-control/flow-regulation element further comprises a resilience-adjusting means for adjusting a resilience of said elastic portion of said conduit, wherein said resilience-adjusting means comprises:

an enclosure that surrounds at least at a part of said elastic portion, said enclosure and said part of said elastic portion defining a pressure-tight chamber; and pressure-adjustment means that adjusts pressure within said enclosure.

5. The liquid dispenser of claim 4 wherein said pressure-adjustment means comprises:

gas-supply conduit in fluid communication with said pressure-tight chamber; and means for regulating pressure within said pressure-tight chamber.

6. The liquid dispenser of claim 5 further comprising a vacuum flow line that is in fluid communication with said pressure-tight chamber.

7. The liquid dispenser of claim 1 wherein said pressurized liquid source comprises a reservoir.

8. The liquid dispenser of claim 7 further comprising means for maintaining said reservoir under constant elevated pressure.

9. A method comprising:

restricting a flow of a pressurized liquid into a conduit, said flow restricted to a first rate;

sensing a pressure of said conduit; and dispensing a portion of said pressurized liquid from said conduit at a second rate that is greater than said first rate.

10. The method of claim 9 wherein the step of sensing further comprises sensing a change in pressure of said conduit.

11. The method of claim 9 further comprising controlling a resilience of said conduit.

12. The method of claim 9 further comprising maintaining said dispensed portion of pressurized liquid at a baseline condition by controlling said resilience of said conduit.

* * * * *

UNITED STATES PATENT AND TRADEMARK OFFICE

CERTIFICATE OF CORRECTION

PATENT NO. : 6,357,636 B2
DATED : March 19, 2002
INVENTOR(S) : Ilya Feygin

It is certified that error appears in the above-identified patent and that said Letters Patent is hereby corrected as shown below:

Column 5,
Line 1, delete “impression” and insert -- imprecision --.

Column 8,
Line 2, delete “9” and insert -- 11 --.

Signed and Sealed this

Twentieth Day of July, 2004

JON W. DUDAS
*Acting Director of the United States Patent and Trademark Office*